United States Patent [19]

Staudenmayer et al.

[11] Patent Number: 4,990,422

[45] Date of Patent: Feb. 5, 1991

[54] SENSITIZATION OF METHINE DYES BY AGGREGATED PYRYLIUM DYES

[75] Inventors: William J. Staudenmayer, Pittsford; Michael T. Regan, Fairport, both of N.Y.

[73] Assignee: Eastman Kodak Company, Rochester, N.Y.

[21] Appl. No.: 429,910

[22] Filed: Oct. 30, 1989

[51] Int. Cl.[5] ..... G03G 15/02

[52] U.S. Cl. ..... 430/59; 430/57

[58] Field of Search ..... 430/59, 57

[56] References Cited

U.S. PATENT DOCUMENTS

| | | | |
|---|---|---|---|
| 3,958,991 | 5/1976 | Jones et al. . | |
| 3,973,962 | 8/1976 | Contois et al. . | |
| 4,513,071 | 4/1985 | Mey | 430/19 |
| 4,634,553 | 1/1987 | Detty et al. | 430/83 |
| 4,687,722 | 8/1987 | Ogawa | 430/59 |
| 4,769,022 | 9/1988 | Chang et al. . | |
| 4,857,431 | 8/1989 | Kato et al. | 430/91 |

OTHER PUBLICATIONS

William Mey, Multi-Active Photoconductive Element, #13324, Research Disclosure, May 1975, pp. 44–47.

*Primary Examiner*—Marion E. McCamish
*Assistant Examiner*—Stephen C. Crossan
*Attorney, Agent, or Firm*—Dressler, Goldsmith, Shore, Sutker & Milnamow, Ltd.

[57] ABSTRACT

Photoconductive compositions of methine dye and aggregated pyrylium dye which, when incorporated into charge generation compositions for use in photoconductive film elements, display extended spectral sensitivity, enhanced visibility, and high resolution characteristics compared to either dye used separately. Preferred methine dyes are cyanine dyes with near infra red region sensitivity. The film elements also display reduced energy requirements for discharge.

14 Claims, 3 Drawing Sheets

SENSITIZATION OF METHINE DYES BY AGGREGATED PYRYLIUM DYES

FIELD OF THE INVENTION

This invention is in the field of photosensitive dyes.

BACKGROUND OF THE INVENTION

Methine dyes are known to be useful in photoconductive compositions and elements, as are certain aggregated methine dyes. For example, U.S. Pat. No. 4,769,022 describes photoconductive compositions and elements containing methine dyes in the J-aggregate state.

Aggregate photoconductive elements have been described extensively in the prior art, and, in particular, photoconductive compositions containing aggregated pyrylium dyes have been taught; see, for example, U.S. Pat. Nos. 3,615,418 and 3,973,962.

However, so far as is known, combinations of non-aggregated methine dyes with aggregated pyrylium dyes have not heretofore been known.

SUMMARY OF THE INVENTION

This invention provides novel compositions that comprise methine dyes with aggregated pyrylium dyes.

The compositions of the present invention display greater spectral sensitivity than can be achieved by either component separately, and, when incorporated into photoconductive elements, these compositions display reusability, enhanced photosensitivity in the visible regions of the spectrum, and high resolution characteristics.

Particularly when the methine dye is a cyanine dye of the type having near infrared region sensitivity, it has now been discovered that the combination thereof with aggregated pyrylium dyes unexpectedly produces an outstanding extension of spectral sensitization in the near infrared region.

This invention further provides photoconductive charge generation compositions comprising at least one methine dye, at least one aggregated pyrylium dye, an electron donor agent, and an organic solvent soluble polymeric binder.

This invention also provides photoconductive elements that comprise successive layers of a substrate; an electrically conductive layer; a charge barrier layer; a photoconductive charge generation layer of the present invention; and, an optional charge transport layer.

Other and further aims, purposes, features, advantages and the like will be apparent to those skilled in the art when taken with the accompanying drawings and appended claims.

DETAILED DESCRIPTION

Figure 1:
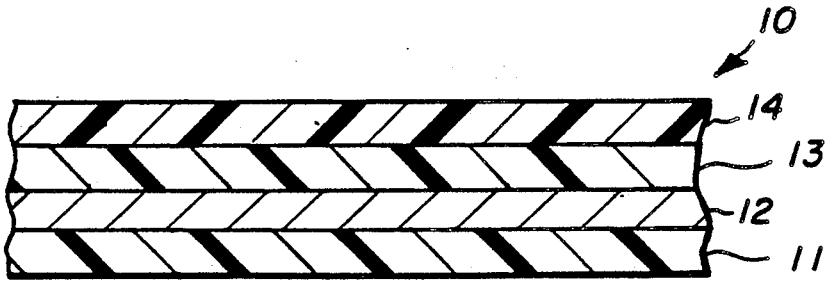
FIG. 1 is a fragmentary enlarged vertical sectional view through one embodiment of a photoconductive element of the present invention.

The methine dyes used as spectral sensitizers in accordance with the present invention are tricarbocyanine dyes, represented by the formula:

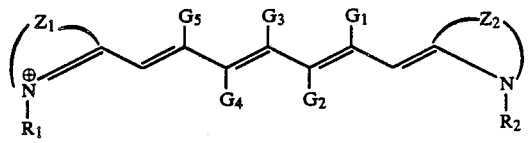

wherein:

$Z_1$ and $Z_2$ each represent a basic azole, azine, pyridine, or 3H-indole heterocyclic nucleus;

$R_1$ and $R_2$ each represent a quaternizing substituent;

X represents a counterion;

$G_1$, $G_2$, $G_4$ and $G_5$ represent hydrogen, and each pair of $G_1$ and $G_3$, and $G_3$ and $G_5$, and $G_2$ and $G_4$, taken together, separately comprise the atoms to complete a single six-membered alicyclic ring; and $G_3$ can represent hydrogen, a lower alkyl group, or a halogen atom.

Examples of nuclei formed by $Z_1$ and $Z_2$ are imidazo[4,5-b]quinoxaline, 3H-pyrrolo[2,3-b]pyridine, thiazolo[4,5-b]quinoline, and the nitro-substituted nuclei: pyridine, quinoline, oxazole, benzoxazole, naphthoxazole, thiazole, benzothiazole, naphthothiazole, 3H-indole, 3H-naphthindole, benzimidazole, naphthimidazole.

Presently preferred methine dyes are cyanine dyes, including so called simple cyanines; isocyanines; merocyanines, including cyanine dyes which contain an amidic chromophobe system; cryptocyanines; carbocyanines; polycarbocyanines, such as dicarbocyanines, tricarbocyanines, and the like; symmetrical as well as unsymmetrical cyanine dyes; chain-methine substituted cyanine dyes; and the like. In general, the term "cyanine dye" as used herein denotes a dye containing two heterocyclic groups (usually quinoline nuclei) connected by a chain of conjugated, double bonds containing an odd number of carbon atoms, such as, for example, cyanine blue, and includes dyes which contain an amidinium moiety, as described in Mees and James book "The Theory of the Photographic Process" published by MacMillan Co. (1966) pp. 201–202. Particularly useful cyanine dyes are those which display infrared sensitivity in the near infrared region.

A wide variety of pyrylium dyes are useful in the present invention. These include pyrylium dyes of the formula:

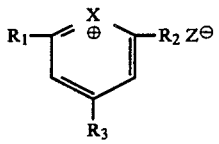

(2)

wherein:

$R_1$ and $R_2$ are each independently selected from the group consisting of phenyl groups, lower alkyl substituted phenyl groups and lower alkoxy substituted phenyl groups;

$R_3$ is selected from the group consisting of mono(-lower alkyl)amino-substituted phenyl groups, di(lower alkyl)amino-substituted phenyl groups, mono(lower monohaloalkyl)amino-substituted phenyl groups and di(lower monohaloalkyl)amino-substituted phenyl groups, X is selected from the group consisting of oxygen, sulfur, selenium and tellurium; and Z is an anion.

The term or syllable "halo" as used herein by itself or as a part of a chemical name designates a fluoro-, chloro-, bromo- or iodo-monovalent halogen atom.

The term "anion" as used herein designates a negatively charged ion which satisfies a net positive charge inherently associated with the chromophore-groupcontaining organic structure. Preferred anions in formula (2) compounds are perchlorate, fluoroborate and hexafluorophosphate.

The term "dye" or "dyes" as used herein means organic compound(s) which absorb radiation in the visible range of the spectrum as well as in the near ultraviolet range and near infrared range of the spectrum.

The term "aggregate", "aggregates", "aggregated", "aggregation" as used herein in reference to a pyrylium dye or dyes means that molecules of such dye or dyes have coalesced and become clumped together in a heterogeneous crystalline form and are no longer irregularly distributed in, for example a binder polymer matrix as individual molecules. The size of an individual aggregate mass can vary, but, for purposes of the present invention, an aggregate mass is preferably under about 3 microns in average diameter, and more preferably under about 1 micron, in average diameter. For purposes of the present invention, a pyrylium dye aggregate of the type contemplated for use in the present invention may consist of (a) one or more aggregated pyrylium dyes, (b) an aggregated combination of at least one aggregated pyrylium dye and at least one cyanine dye, or (c) at least one dye-dye pyrylium aggregate such as taught in U.S. Pat. No. 4,429,030 which aggregates are characterized by having a dye structure represented by the formula:

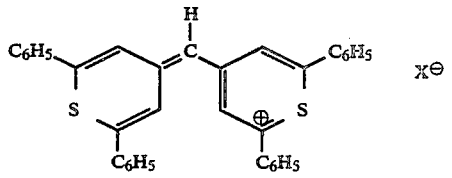

wherein X is an anion.

Preferred anions for formula (3) compounds are perchlorate and fluoroborate.

Preferred aggregated pyrylium dyes include those disclosed in U.S. Pat. Nos. 3,615,414 and 4,429,030.

As is well known in the dye art, a dye can be aggregated by any convenient procedure and many dye aggregation procedures are known to the dye art. However, in practicing the present invention, selective or preferential aggregation of pyrylium dyes is accomplished without aggregation of the methine dye. In the practice of the present invention, it is convenient and presently preferred to induce selective pyrylium dye aggregation by preliminarily dissolving at least one pyrylium dye in a substantially non-polar organic solvent, along with methine dye(s) and any other selected components, as taught herein. Suitable nonpolar organic solvents include hydrocarbons, such as alphatic and aromatic types. Presently preferred hydrocarbons are aromatics such as benzene, toluene, xylene, and the like. The solution is then coated on to an appropriate substrate, such as taught herein in making a photoconductive element. The coating is then dried to remove the solvent. It is found that the pyrylium dye(s) present have been selectively aggregated in the dried product coating.

If, for example and in contrast to the present invention, a strongly polar organio solvent is used in place of this substantially non-polar organic solvent in the above indicated procedure, it is found that the pyrylium dyes are not aggregated in the dried product coating. Examples of such strongly polar organic solvents include halogenated materials such as dichloromethane, carbon tetrachloride, symtetrachlorethane, and the like.

Another procedure for inducing selective pyrylium dye aggregation involves producing a dried product coating using the above indicated procedure with a strongly polar solvent (in place of the non-polar solvent). The resulting dried coating layer is then exposed to vapors of such a strongly polar solvent, such as dichloromethane, or the like. Apparently, a selective or partial solvent action occurs with the result that, after subsequent drying in air, the pyrylium dye in the layer is found to have become aggregated.

The presently preferred procedure for selectively aggregating the pyrylium dye is by the addition of aggregate seed.

In the compositions of the present invention, the weight ratio of methine dye to aggregated pyrylium dye can vary widely, but is preferably in the range of about 300:1 to about 1:2, and more preferably is in the range of about 150:1 to about 2:1. For use in a charge generation layer, such a composition can be preliminarily separately prepared, or can be prepared in situ at the time when a coating composition for making a charge generation layer is being prepared, such as is herein described.

A photoconductive charge generation layer composition of this invention comprises:

(a) at least one methine dye (preferably cyanine);

(b) at least one aggregated or aggregatable pyrylium dye;

(c) an optional electron donor agent; and (d) an organic solvent soluble organic polymeric binder.

To aid in achieving a charge generation layer of maximized spectral sensitivity, a coating composition incorporating at least one aggregatable pyrylium dye and at least one methine dye has added thereto an electron donor, such as one already known to the prior art. Suitable examples of electron donor compounds include 1,1-bis(4-di-p-tolylaminophenyl) cyclohexane (as taught in U.S. Pat. No. 4,127,412), tri-p-tolylamine, and the like.

A coatable charge generation layer composition contains a combination of methine dye, aggregatable pyrylium dye and a polymeric organic binder. Preferred binders are film-forming, hydrophobic polymeric materials having fairly high dielectric strength and good electrically insulating properties. Examples include styrene-butadiene copolymers; silicone polymers; styrene-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyryl); polyacrylic and methacrylic esters, such as poly(methylmethacrylate), a poly-(n-butyl methacrylate), poly(isobutyl methacrylate), etc.; polystyrene; nitrated polystyrene; polymethylstyrene; isobutylene polymers; polyesters, such as polymethylstyrene; isobutylene polymers; polyesters, such as poly [ethylene-co-alkylene-bis (alkylene-oxyaryl)-phenylenedicarboxylate]; phenol formaldehyde resins, ketone resins; polyamides; polycarbonates; polythiocarbonates; poly[ethylene-co-isopropylidene-2,2-bis(ethylene-oxyphenylene) terephthalate]; copolymers of vinyl haloarylates and vinyl acetate, such as poly-(vinyl-m-bromobenzoate-co-vinyl acetate); and the like. Methods for making such polymers are described in the prior art. While any conventional polymeric binders known to the prior art of charge generation layers in photoconductive elements can be employed, an organic solvent soluble polyester (especially a polyethylene terephthalate), or an organic solvent soluble polycarbonate, is presently preferred. A convenient and presently preferred weight ratio of the combined weight of methine dye and aggregated pyrylium dye to the organic polymeric binder is in the range of about 1:4 to about 1:100, although larger and smaller weight ratios can be employed.

If an electron donor agent is added to the coating composition, the weight ratio of such agent to the combined weight of both the methine dye and the pyrylium dye is preferably in the range of about 1:2 to about 1:150, and more preferably in the range of about 1:4 to about 1:70.

To prepare a charge generation layer coating composition of this invention, it is convenient and preferred to dissolve the pyrylium dye and the methine dye materials in a common solvent medium, a present preference being in a non-polar aromatic hydrocarbon which selectively induces pyrylium dye aggregation, as above herein explained. The weight ratio of pyrylium dye to methine dye is within the weight ratio range above indicated.

A presently preferred methine dye is a cyanine dye which is sensitive to infrared radiation in the near infrared region. Similarly, a presently preferred aggregatable pyrylium dye is a thiopyrylium dye.

The total solids content present in a charge generation layer coating composition can vary widely, but preferably is in about the 8 to 15 weight percent range with the balance up to 100 weight percent thereof being the solvent.

Mixtures of different solvents can be employed, if desired. In general, solvents heretofore used in the art of making photoconductive elements may be employed. Various volatile coating solvents suitable for use in the invention include aromatic hydrocarbons, such as benzene, including substituted aromatic hydrocarbons, such as toluene, xylene, mesitylene, etc.; ketones, such as acetone, 2-butanone, etc.; halogenated aliphatic hydrocarbons, such as methylene chloride, trichloroethylene, 1,1,2-trichloroethane, chloroform, ethylene chloride, etc.; ethers, including cyclic ethers, such as tetrahydrofuran, diethyl ether; etc.; mixtures of the foregoing; and the like. Presently preferred solvents are methylene chloride, 1,1,2-trichloroethane and toluene.

Photoconductive film elements incorporating a charge generation layer of this invention wherein the light-responsive components comprise a composition comprising at least one aggregated pyrylium dye and at least one methine dye need have no special or critical structure which is different from prior art structures of photoconductive elements incorporating a charge generation layer.

Figure 2:
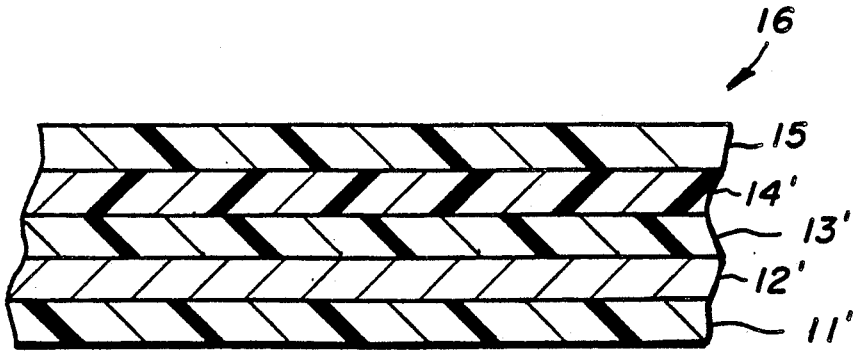
FIG. 2 is a view similar to FIG. 1 but showing another embodiment of a -photoconductive element of the present invention.

One presently preferred class of new and very useful photoconductive film elements provided by the present invention incorporates a composition of at least one aggregated pyrylium dye and at least one methine dye in a charge generation layer. Examples of this class of elements are illustrated in FIGS. 1 and 2. Referring to FIG. 1, there is seen one embodiment of a photoconductive film element of this invention which is designated in its entirety by the numeral 10.

Film element 10 incorporates a substrate 11 comprised of a substantially solvent inert, electrically inert, and electrically insulative, thermally stable film. Any of the substrates known to the photoconductive element art can be employed. Presently preferred substrates include polycarbonates and polyesters, especially polyethylene terephthalate. Substrate 11 can have a thickness which varies widely, but which typically is in the range from about 100 to about 200 mircons.

Substrate 11 is coated on one surface with an electrically conductive layer 12. Any of the electrically conductive layers known generally to the prior art of photoconductive elements can be employed. Suitable conductive layers can utilize a metal-containing semiconductor compound, such as cuprous iodide, silver iodide, and the like, as described, for example in U.S. Pat. Nos. 3,245,833 and 3,428,451, dispersed in a resin. Compositions of protective inorganic oxide and metal as described in U.S. Pat. No. 3,880,657, can be used as can coatings comprised of vinyl acetate polymer and sodium salt of a carboxyesterlactone of maleic anhydride as described in U.S. Pat. Nos. 3,007,901 and 3,262,807. Organic conductors and semiconductors can also be used, as taught for example, by U.S. Pat. Nos. 3,634,336 and 3,754,986; and French Patent No. 2,084,997. However, it is presently preferred to employ a vacuum vapor deposited electrically conductive metal layer, such as aluminum, nickel, copper, silver, gold, or the like. A presently preferred metal is nickel. Preparation of such layers is well known to the art. It is presently preferred to employ a metal conductive layer having a thickness in the range of about 50 to about 1000 Angstroms so as to achieve a conductive layer having a resistance in the range of about 10 to about $10^4$ ohms per centimeter.

Conductive layer 12 is overcoated with a charge barrier or subbing layer 13. Layer 13 is typically and preferably an organic polymer and can be any of the binder resin materials heretofore taught in the art of photoconductive film elements for use as a charge barrier layer. Presently preferred as a charge barrier layer composition is a vinylidene chloride/acrylonitrile copolymer containing on a total polymer weight basis about 83 weight percent vinylidene chloride and about 17 weight percent acrylonitrile, and having a molecular weight in the range of about $10^4$ to about $10^7$. Layer 13 typically and preferably has a thickness in the range of about 0.01 to about 1 micron, and preferably about 0.02 to about 0.10 micron.

Layer 13 is conveniently applied as a solution in a polar or non-polar organic solvent, such as a solvent as hereinabove described for use in formulating a charge generation coating composition.

Layer 13 is overcoated with a charge generation layer composition of this invention as hereinabove described. Such a composition is applied in a layer thickness such that, after drying and heat processing (curing), the thickness of the resulting layer 14 is in the range of about 2 to about 20 microns, and preferably about 5 to about 15 microns. After being applied uniformly, and then preferably air dried, charge generation layer 14 is heated or cured at an elevated temperature; for example, at a temperature of about 50 to about 110° C. for a time of about 2 to about 25 minutes.

Referring to FIG. 2, there is seen another photoconductive film element of the present invention which is designated in its entirety by the numeral 16 which is similar to embodiment 10. Similar components are similarly numbered, but with the addition of prime marks thereto for identification. Film element 16 incorporates a substrate 11', a conductive layer 12', a subbing layer 13' and a charge generation layer 14' that is overcoated with a charge transport layer 15.

The charge transport layer 15 is preferably comprised of a composition comprising at least one electron donor agent in a polymeric binder. One presently preferred composition which is useful in producing a layer 15 comprises a mixture of at least one electron donor agent and a binder both dissolved in a solvent. The electron donor(s) comprise about 20 to about 50 weight percent of layer 15 with the balance up to 100 weight percent thereof comprising the binder (on a solids basis). As the binder, one can employ any of the binders heretofore known to the art for use in charge generation or charge transport layers; however, presently preferred binders comprise organic solvent soluble polycarbonates and polyesters, particularly polyethylene terephthalate. A presently preferred electron donor agent is 1,1-bis(4-di-p-tolylaminophenyl)cyclohexane. The charge transport layer is preferably applied from a solution of the electron donor agent and the binder in an organic solvent wherein the total solids content is from about 7 to about 15 weight percent of the total composition. The solvent can be similar to the types employed in charge generation layer compositions (as hereinabove described). In such a composition, the weight ratio of electron donor agent to polymers binder preferably is in the range of about 1:6 to about 2:1, and more preferably about 1:4 to about 1:1.

Such a composition is applied, then preferably preliminarily dried, and finally heated or cured at a temperature ranging from about 50° to about 110° C. for a time of about 2 to about 25 minutes. The resulting charge transport layer 15 thickness is preferably in the range of about 5 to about 50 and, more preferably, about 7 to about 30 microns, although larger and smaller thickness can be employed, if desired.

Particularly when a photoconductive film element is prepared with a preferred methine dye (cyanine) and with a preferred aggredgated pyrylium dye (thiopyrylium), there results a film element with enhanced sensitivity to radiation in the near infrared region.

Photoconductive film elements of this invention also generally display reusability, enhanced visibility and sensitivity in the visible spectral regions, and high image resolution characteristics. Also, they require reduced amounts of energy for discharge compared to the same elements wherein the pyrylium dye is not aggregated.

For purposes of this invention, the term "near infrared region" has reference to spectral wavelengths in the range of about 700 to about 900 nm.

The invention is illustrated by the following examples:

EXAMPLE 1

Effect of unaggregated pyrylium dye on cyanine dye (Control)

A nickelized polyester (polyethylene terephthalate) film support was prepared.

This support was coated on one face with a vinylidene chloride/acrylonitrile copolymer layer.

The vinylidene chloride copolymer layer was overcoated with a charge generation layer by applying a charge generation layer composition containing 9 weight percent solids with the balance up to 100 weight percent thereof being solvent on a solvent on a total charge generation layer composition basis. The solids composition was as follows:

| Component | Wt. % (total comp. basis) |
|---|---|
| nitro-substituted cyanine dye | 0.1 |
| polyester binder | 2.4 |
| aggregate seed | .6 |
| thiopyrylium dye #1 | 6.4 |
| thiopyrylium dye #2 | 1.6 |
| polycarbonate binder | 49.3 |
| 1,1-bis(4-di-p-tolylaminophenyl)-cyclohexane | 38.9 |
| tri-p-tolylamine | 0.8 |

The solvent for this composition (89 weight percent on a total charge generation composition basis) was an 80/20 weight ratio mixture of dichloromethane and 1,1,2-trichloroethane. In this solids composition, the nitro-substituted cyanine dye had the structure:

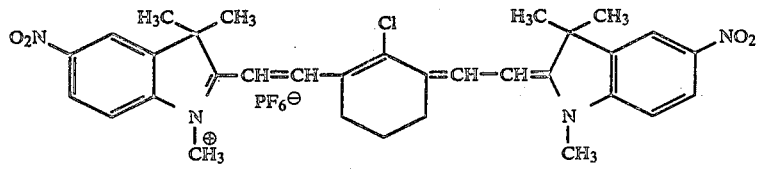

The tiopyrylium dye #1 had the structure:

(5)

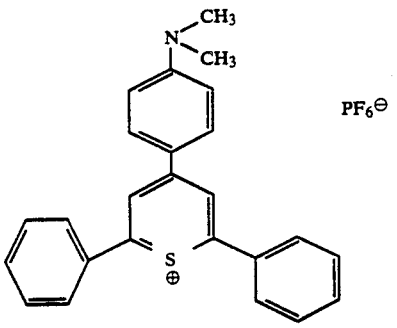

The thiopyrylium dye #2 had the structure:

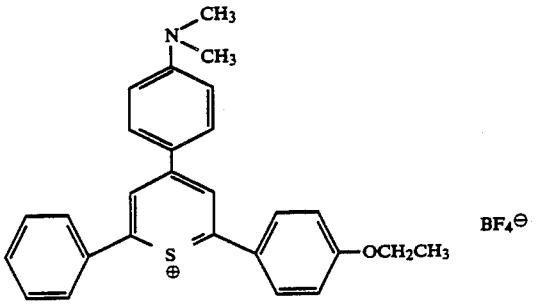

The aggregate seed was prepared by shearing a solution of a dye of Formula (5) and Lexan 145 in a dichloromethane solution (12% solids by weight) in a Waring blender.

The polyester binder was copolymer of neopentyl glycol and terephthalic acid.

The polycarbonate binder was Lexan 145.

The 1,1-bis(4-di-p-tolylaminopheny)cyclohexane functioned as an electron donor.

The tri-p-tolylamine functioned as a second electron donor.

The charge generation composition was prepared by adding the components to an 80:20 solvent mixture of dichloromethane and 1,1,2-trichloroethane, stirring for 4 hours and coating over the interlayer.

The coating of the charge generation composition was carried out by hand application to the substrate surface using a 0.001 inch coating blade followed by air drying.

The coated layer and associated film structure was then cured for 60 minutes at 60° C.

Then, a 14 weight percent solids content charge transport layer composition was coated over the cured charge generation layer. This charge transport layer composition had the following solids formulation:

| Component | Wt. % (100 wt. % basis) |
|---|---|
| polycarbonate | 65 |
| 1,1-bis(4-di-p-tolylamino-phenyl) cyclohexane | 35 |

The polycarbonate was obtained commercially from the General Electric Co. under the trademark "Lexan 145." This solids formulation was dissolved in 86 weight percent dichloromethane (on a 100 weight percent total composition basis).

The charge transport layer composition was applied by hand using a 0.007 inch coating blade followed by air drying and curing for 60 minutes at 60° C.

Figure 3:
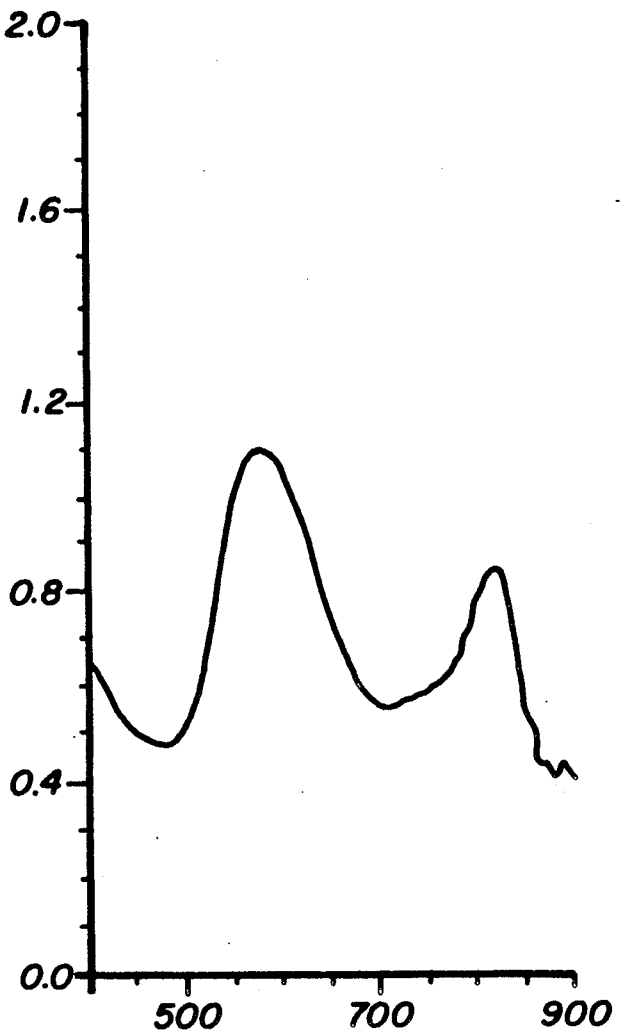
FIG. 3 is a plot showing the spectral absorption characteristics of the -photoconductive film element of Example 1 wherein the abscissa shows frequency in nanometers (nm) and the ordinate shows absorption density in optical density units.
Figure 6:
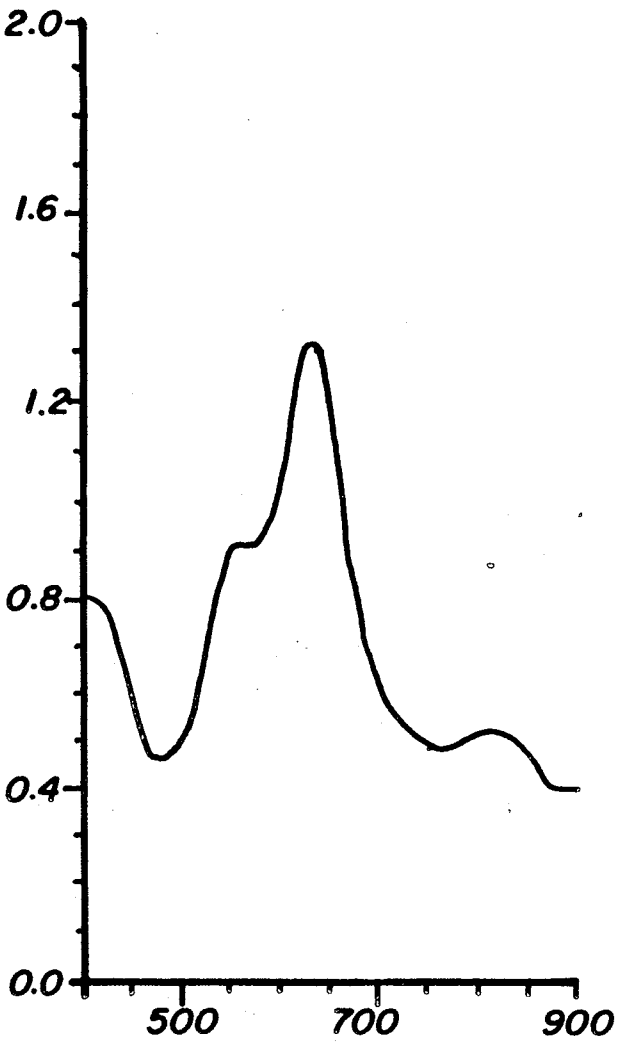
FIG. 6 is a plot similar to the plot of FIG. 3 but showing the spectral absorption characteristics of the photoconductive film element of Example 4.

The resulting photoconductive film element had a layered structure as shown in FIG. 1 wherein layer 10 was the polyester layer, layer 11 was the nickel layer, layer 12. Was the vinylidene chloride copolymer layer, layer 13 was the charge generation layer and layer 14 was the charge transport layer. The spectral absorption characteristics of this film element are shown in FIG. 3, and these characteristics are similar to those of the thiopyrylium dye in solution and are not characteristic of the aggregated thiopyrylium dye.

The photoconductive response of this element was measured by corona charging the film element to Θ 200 volts and exposing it to monochromatic light at 810 nm. The film element was found to discharge to 100 volts With the use of 490 ergs/cm$^2$ (E ½). When exposed to monochromatic light at 630 nm, the film discharged with slightly less than about 500 ergs/cm$^2$ exposure (E ½).

EXAMPLE 2

Effect of aggregated pyrylium dye on cyanine dye (invention)

The procedure of Example 1 (above) was repeated except that the charge transport layer was coated from toluene instead of dichloromethane to cause aggregation of the thiopyrylium dye. In addition, the polycarbonate binder in the charge transport layer was replaced with an equal amount of polyester because the polycarbonate was not sufficiently soluble in toluene.

Figure 4:
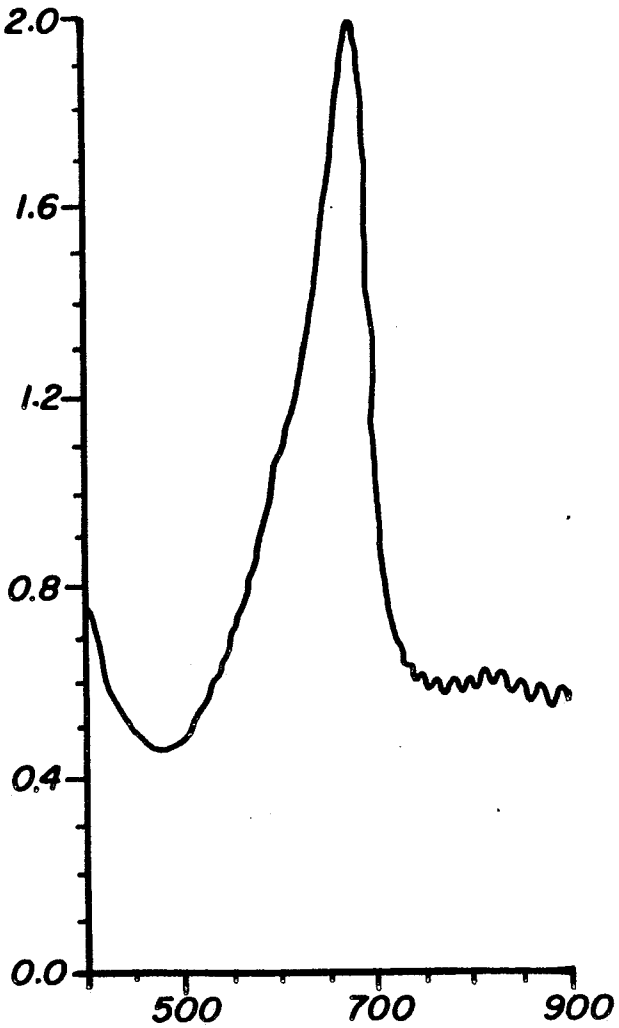
FIG. 4 is a plot similar to the plot of FIG. 3 but showing the spectral absorption characteristics of the photoconductive film element of Example 2.

The resulting photoconductive film element had a layered structure similar to that of Example 1 and as shown in FIG. 1. The spectral absorption curve for this element is shown in FIG. 4 and indicated that the thiopyrylium dye had been converted to an aggregated state.

The photoresponse of this element was measured as in Example 1 and found to exhibit an E ½ of only 38 ergs/cm$^2$ at 810 nm. Comparison of the sensitometric results of Example 1 (unaggregated dye) and the present example (aggregated dye) show that the aggregated dye system of the present example produced a significant higher photoresponse (i.e., 12.9 times higher) than did the unaggregated dye of Example 1. When exposed to monochromatic light at 630 nm, the film discharged with only 2.5 ergs/cm$^2$ exposure (E ½).

This example illustrates and demonstrates the use of an aggregated pyrylium dye to chemically sensitize a cyanine dye.

EXAMPLE 3:

Effect of Unaggregated Pyrylium Dye on Cyanine Dye (Control)

A 12 weight percent solids formulation comprising:

| Component | Wt. % (100 Wt. % Basis) |
|---|---|
| polycarbonate | 59.5 |
| tri-p-tolylamine | 39.25 |
| pyrylium dye | 1.0 |
| cyanine dye | 0.25 |

was dissolved in 88 weight percent dichloromethane.

The polycarbonate was obtained commercially from General Electric Co. under the trademark "Lexan 145."

The pyrylium dye had the structure shown in formula (3) above.

The cyanine dye is identical to the nitro-substituted cyanine dye of Examples 1 and 2.

This charge generation composition was coated on the same subbed base structure used in Example 1 by hand using a 0.005 inch coating blade, followed by air drying. The resulting element was then cured for 60 minutes at 60° C.

Figure 5:
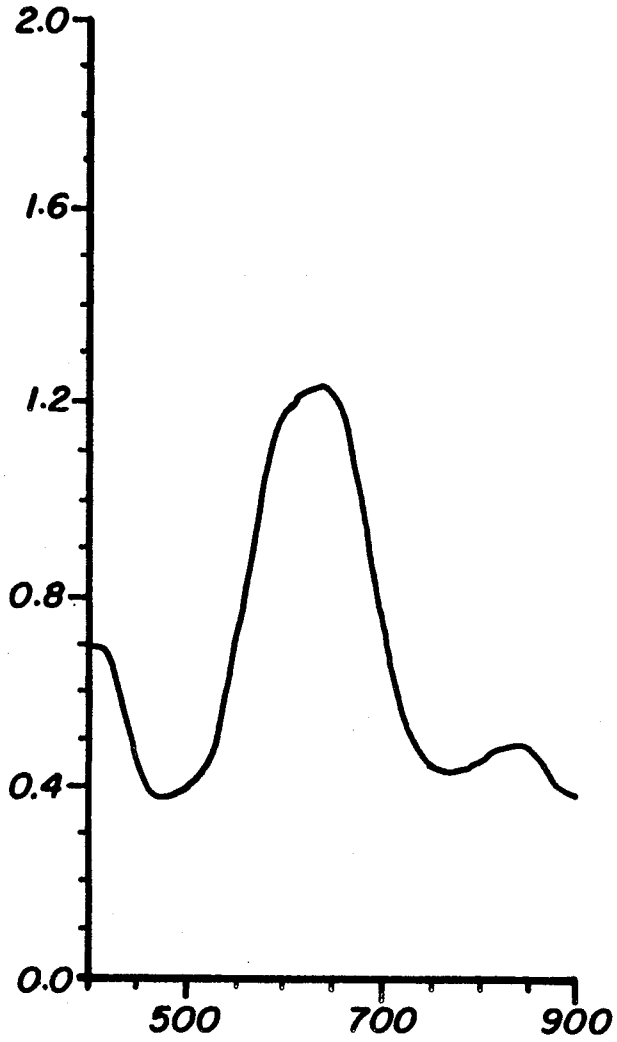
FIG. 5 is a plot similar to the plot of FIG. 3 but showing the spectral absorption characteristics of the photoconductive element of Example 3.

The absorption spectra of the resulting photoconductive element was measured and found to be as shown in FIG. 5, and it was noted that dye-dye aggregation of the type described in U.S. Pat. No. 4,429,030 had not occurred.

EXAMPLE 4:

Effect of Aggregated Pyrylium Dye on Cyanine Dye

A sample of the Example 3 film element was held over a glass beaker containing dichloromethane for 2.5 minutes and then air cured at 60° C. for 60 minutes.

The absorption for this treated film was measured and found to be as shown in FIG. 4. It was evident that dye-dye aggregation had taken place.

The photoresponse of the elements of Example 3 and the present Example 4 were obtained as described in Example 1 and the following data were obtained:

TABLE 1

Photoresponse of Elements of Examples 3 and 4

| Example | Charge Voltage Range | $E\frac{1}{2}$ (ergs/cm$^2$) (650 nm) | $E\frac{1}{2}$ (ergs/cm$^2$) (810 nm) | Relative Sensitivity (810 nm) |
|---|---|---|---|---|
| 3 | 0 500 | >91 | 1484 | 1.0X (control) |
| 4 | 0 450 | 7.7 | 462 | 3.2X |

Example 4 illustrates an embodiment of this invention incorporating a dye-dye aggregated element which has photosensitivity in the infrared spectral region.

Examples 2 and 4 illustrate the chemical sensitization of the infrared-sensitive cyanine dye by the aggregated pyrylium dye relative to Examples 1 and 3 which serve as controls to illustrate the effect of the unaggregated dye on the same infra-red sensitive cyanine dye.

The foregoing specification is intended as illustrative and is not to be taken as limiting. Still other variations within the spirit and the scope of the invention are possible and will readily present themselves to those skilled in the art.

I claim:

1. A photoconductive composition comprising:
(a) at least one methine dye, and
(b) at least one aggregated pyrylium dye.

2. The composition of claim 1 wherein the weight ratio of (a) to (b) is in the range of about 1:200 to about 1:1.

3. The composition of claim 1 which additionally includes in admixture therewith an electron donor agent.

4. The composition of claim 3 wherein the weight ratio of said agent to the combined weight of said methine dye and said pyrylium dye is in the range of about 80:1 to about 2:1.

5. The composition of claim 1 wherein said methine dye is a cyanine dye which is sensitive to infra red radiation.

6. The composition of claim 1 wherein said pyrylium dye is at least one thiopyrylium dye.

7. The composition element of claim 1 wherein said pyrylium dye is at least one selenopyrylium dye.

8. The composition element of claim 1 wherein said pyrylium dye is at least one telluropyrylium dye.

9. A photoconductive charge generation composition comprising:
(a) at least one methine dye;
(b) at least one aggregated pyrylium dye;
(c) an electron donor agent; and
(d) an organic solvent soluble polymeric binder.

10. The composition of claim 7 wherein: the weight ratio of (a) to (b) is in the range of about 70 to about 1;
the weight ratio of (c) to the combined weight of (a) and (b) is in the range of about 5 to about 1; and
the weight ratio of the combined weight of (a) and (b) to (d) is in the range of about 1 to about 7.

11. The composition of claim 9 wherein said methine dye is a cyanine dye which is sensitive to infra red radiation.

12. The composition of claim 9 wherein said pyrylium dye is at least one thiopyrylium dye.

13. A reusable photoconductive element having sensitivity in the near infrared region comprising in combination successive layers of:
(a) a substrate;
(b) an electrically conductive layer;
(c) a charge barrier layer; and
(d) a photoconductive charge generation layer that comprises in combination a mixture of at least one methine dye, at least one aggregated pyrylium dye, at least one electron donor, and at least one polymeric binder.

14. The photoconductive element of claim 13 wherein said charge generation layer is overcoated with a charge transport layer.

* * * * *

UNITED STATES PATENT AND TRADEMARK OFFICE

CERTIFICATE OF CORRECTION

PATENT NO. : 4,990,422

DATED : February 5, 1991

INVENTOR(S) : William J. Staudenmayer & Michael T. Regan

It is certified that error appears in the above-identified patent and that said Letters Patent is hereby corrected as shown below:

Col. 1, line 62: "-photoconductive" should be --photoconductive--

Col. 1, line 65: "-photoconductive" should be --photoconductive--

Col. 2, line 22: --$X^{\ominus}$-- should be inserted below the formula between "$G_2$" and "$R_1$"

Col. 3, line 20: "chromophore-groupcontaining" should be --chromophore-group-containing--

Col. 4, line 5: "nonpolar" should be --non-polar--

Col. 4, line 16: "organio" should be --organic--

Col. 7, line 68: "aggredgated" should be --aggregated--

Col. 8, line 26: "being solvent on a solvent" should be --being solvent--

Col. 9, line 38: "1,1-bis(4-di-p-tolylaminopheny) cyclohexane" should be --1,1-bis(4-di-p-tolylaminophenyl)cyclohexane--

Col. 12, line 19: "composition element" should be --composition--

Col. 12, line 21: "composition element" should be --composition--

Signed and Sealed this

Twenty-seventh Day of October, 1992

*Attest:*

DOUGLAS B. COMER

*Attesting Officer*

*Acting Commissioner of Patents and Trademarks*